US009499874B2

(12) United States Patent
Poloni et al.

(10) Patent No.: US 9,499,874 B2
(45) Date of Patent: Nov. 22, 2016

(54) HANDLING MACHINE FOR RAILS AND HANDLING PROCESS ASSOCIATED THERETO

(75) Inventors: Alfredo Poloni, Fogliano Redipuglia (IT); Marco Schreiber, Brescia (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 1366 days.

(21) Appl. No.: 13/138,325

(22) PCT Filed: Feb. 3, 2010

(86) PCT No.: PCT/EP2010/051309

§ 371 (c)(1),
(2), (4) Date: Oct. 12, 2011

(87) PCT Pub. No.: WO2010/089325

PCT Pub. Date: Aug. 12, 2010

(65) Prior Publication Data

US 2012/0034053 A1 Feb. 9, 2012

(30) Foreign Application Priority Data

Feb. 3, 2009 (IT) ..... MI2009A0127

(51) Int. Cl.

| | |
|---|---|
| ***B21B 39/24*** | (2006.01) |
| ***C21D 9/06*** | (2006.01) |
| *B21B 1/085* | (2006.01) |
| *C21D 1/63* | (2006.01) |

(52) U.S. Cl.

CPC ..... *C21D 9/06* (2013.01); *B21B 39/24* (2013.01); *B21B 1/085* (2013.01); *C21D 1/63* (2013.01); *C21D 2221/00* (2013.01)

(58) Field of Classification Search

CPC ..... B65G 47/22; B65G 47/82; B65G 46/52; B65G 47/56; B65G 47/646; B21B 39/20–39/24

See application file for complete search history.

(56) References Cited

U.S. PATENT DOCUMENTS

| | | | | |
|---|---|---|---|---|
| 2,095,946 | A * | 10/1937 | Blage | 266/130 |
| 5,054,746 | A * | 10/1991 | Buchegger | 266/114 |
| 8,388,775 | B2 * | 3/2013 | Poloni et al. | 148/581 |
| 8,668,788 | B2 * | 3/2014 | Poloni et al. | 148/646 |

FOREIGN PATENT DOCUMENTS

| | | | |
|---|---|---|---|
| DE | 682335 C | * | 10/1939 |
| GB | 266730 | | 12/1927 |
| JP | 2003160813 | | 6/2003 |

* cited by examiner

*Primary Examiner* — Moshe Wilensky
*Assistant Examiner* — Pradeep C Battula
(74) *Attorney, Agent, or Firm* — Stetina Brunda Garred & Brucker

(57) ABSTRACT

A handling machine for rails, arranged in line and immediately downstream of a rolling plant, which allows both to easily handle the rail for transferring it from the roller table to the thermal treatment zone, and to ensure an optimal gripping of the rail along its longitudinal extension, thus effectively contrasting its bending and variations while allowing a longitudinal movement of the rail caused by thermal shrinkage, thus avoiding damages both to the external surface of the rail and to the handlers. A rail handling process is also described, which optimizes moving, positioning along a roller table and maintaining the rail substantially rectilinear during the thermal treatment to which it is subjected.

8 Claims, 12 Drawing Sheets

HANDLING MACHINE FOR RAILS AND HANDLING PROCESS ASSOCIATED THERETO

FIELD OF THE INVENTION

The present invention relates to a handling machine for rails, in particular to a machine suitable for handling at least one rail in a thermal treatment plant for rail heads, said thermal treatment plant being arranged in line and immediately downstream of a rolling plant, and further relates to a rail handling process associated thereto.

STATE OF THE ART

The prior art has various solutions of thermal treatment plants for rolled rails, particularly aimed at hardening the head by means of quenching operation.

Many of these systems are not arranged immediately after the rolling train outlet. This implies the need to stock the rolled rails and subsequently heat them before proceeding with the thermal quenching treatment, with high energy consumption and low efficiency.

In other solutions, instead, these systems are arranged downstream of the rolling mill: the rolled rail is unloaded onto a roller table fixed to the ground; it is then drawn by handlers, comprising complex leverages, which manage the movement of the rail during the thermal treatment to which the rail is subjected; and is finally ejected onto the cooling plate or bed by appropriate expulsion mechanisms. A first drawback of these solutions is the complexity of the rail handling systems which move the rail on the roller table along the thermal treatment plant.

The rails, either heated or directly coming from the rolling mill, are subjected to rapid cooling of the head either by using spraying nozzles, which inject a cooling fluid (water, air or water-air mixture) onto the head of the rail, or by immersing the head itself into a tank containing the cooling fluid.

In particular, if an immersion tank is used, cooling is more uniform lengthwise, but in all cases the temperature difference between the base of the hot rail and the cooled head results in the rail deflection or bending.

In actual fact, the rail is already bent at the rolling plant outlet. In particular, due to the temperature difference between the flange (or sole) and the head, the rail bends forming a concavity on the colder side.

The flange is colder than the head before carrying out the thermal treatment; therefore, the flange has a concave longitudinal profile.

During the thermal treatment, the head cools down faster than the flange, and at the end of the treatment the head is colder than the flange and has a concave longitudinal profile.

After a few minutes, the flange is colder than the rail head again; therefore the concave profile will be present on flange side again.

Therefore, a second drawback of the known solutions is that these variations of longitudinal profile of the rail, more accentuated at the ends, cause the exertion of high vertical forces on the clamps of the rail handlers; these forces could cause the clamps themselves to open and therefore the rail to drop.

The clamps of the prior art have the disadvantage of being unsuitable for withstanding and containing said deflection and its variations during the thermal treatment.

In order to avoid this drawback, handlers with hydraulic actuating cylinders of the rail locking clamps for producing very high clamping forces have been designed. On one hand, these forces ensure a good clamping of the rail while being moved and transferred close to the cooling tank, but on the other hand they hinder the longitudinal movement of the rail caused by thermal shrinkage that the rail itself undergoes when it is cooled down. It is indeed known that a rolled rail, e.g. 100 meters long, becomes about even 100-150 cm shorter when it cools down. This shortening may cause damages both to the rail surface and to the handlers themselves due to the high clamping forces of the clamps on the rail.

Therefore, there is a need for providing a handling machine for rails and a handling process associated thereto which allow to overcome the aforesaid drawbacks.

SUMMARY OF THE INVENTION

It is the main object of the present invention to implement a handling machine for handling rails, arranged in line and immediately downstream of a rolling plant, which allows both to easily handle the rail for transferring it from the roller table to the thermal treatment zone, and to ensure an optimal clamping of the rail along its longitudinal extension, thus effectively withstanding the deflection and its variations while allowing a longitudinal movement of the rail caused by thermal shrinkage, thus avoiding damages both to the external surface of the rail and to the handlers.

Another object of the invention is to provide a thermal treatment plant for rails comprising the aforesaid handling machine.

A further object of the invention is to provide a handling process of the rail which optimizes positioning the rail along a roller table, handling and maintaining the rail substantially rectilinear during the thermal treatment to which it is subjected.

The present invention thus proposes to achieve the objects discussed above by implementing a machine for handling a rail, provided with a head and a flange, which, according to claim 1, comprises:

- a plurality of moving means for taking and turning over the rail from a position inclined on a side thereof to a position wherein the head of the rail is turned upwards;
- a plurality of handlers provided with clamping means adapted to clamp the rail at the flange, and able to move the rail from said position wherein the head of the rail is turned upwards to a position wherein the head is turned downwards, wherein said moving means comprise first levers adapted to be actuated by first actuating means and configured so that they move the rail from the position inclined on a side thereof, provided on a first plane, to the position with the head of the rail turned upwards on a second plane higher than said first plane.

A second aspect of the present invention relates to a thermal treatment plant for rails for subjecting a head of said rails to a thermal treatment in line, the rails exiting from a rolling plant defining a rolling axis, said thermal treatment plant comprising:

- a longitudinal roller table, arranged along the rolling axis;
- a first longitudinal cooling tank, placed adjacent and parallel to said roller table;
- and a handling machine according to claim 1, wherein
  - the first levers are arranged along the roller table, defining said first plane, to extract the rails from said roller table and to overturn them from the position inclined on a side thereof on said roller table to a position wherein the head of the rail is turned upwards on said second plane close to the plurality of handlers;

and first handlers of said plurality of handlers, provided with clamping means adapted to clamp a first rail at the flange, are able to move said first rail from said position wherein the head is turned upwards to a position above the first cooling tank with the head turned downwards.

A further aspect of the present invention includes a handling process for handling a rail by means of the aforesaid handling machine comprising the following steps:

moving the rail by means of first levers of said moving means, from a position inclined on a side thereof, provided on a first plane, to a position wherein the head of the rail is turned upwards on a second plane higher than said first plane;

clamping the rail by means of clamping means of a plurality of handlers by a contact of portions of internal surface of the jaws with the sides of the flange of the rail only;

rotating the handlers for moving the rail from said position wherein the head is turned upwards to a position wherein the head is turned downwards.

The handling machine and process for rails according to the present invention further have the following advantages:

a better clamping of the bent rail, while exerting relatively low clamping forces during thermal quenching treatment in tank, due to the application point of the forces generated by the clamping of the clamps on the bent rail flange being substantially aligned with the rotation fulcrums of the clamps themselves;

possibility of controlling the hydraulic actuating cylinders of the clamps of the handlers so as to shift from:

a high clamping force during the movement of the rail from the position with the head turned upwards to the immersion position of the rail in the cooling tank, to contrast the weight force and the centrifugal force thereof which is produced when the handlers are rotating;

to a sufficiently low clamping force during the immersion to allow for the shortening of the rail due to thermal shrinkage.

The machine and handling process are inserted in a thermal treatment plant layout which includes using three cooling tanks, arranged in series, with the following advantages:

it allows to obtain high production rates in terms of rails treated per unit of time;

it optimizes the occupied spaces and reduces first investment costs related to machine foundations;

it allows to rationalize plant engineering of circuits and water pipe systems feeding cooling tanks;

it is flexible because it allows to unload rolled rails also thermally treating them and to change the production cycle for making heavy sections;

it is modular, i.e. it allows to add other cooling tanks in order to further increase the hourly production rate or treat rails of different size.

The dependent claims describe preferred embodiments of the invention.

BRIEF DESCRIPTION OF THE DRAWINGS

Further features and advantages of the invention will be more apparent in the light of the detailed description of preferred, but not exclusive, embodiments of a handling machine for rails illustrated by way of non-limitative example, with reference to the accompanying drawings, in which.

DETAILED DESCRIPTION OF PREFERRED EMBODIMENTS OF THE INVENTION

Figure 2A:
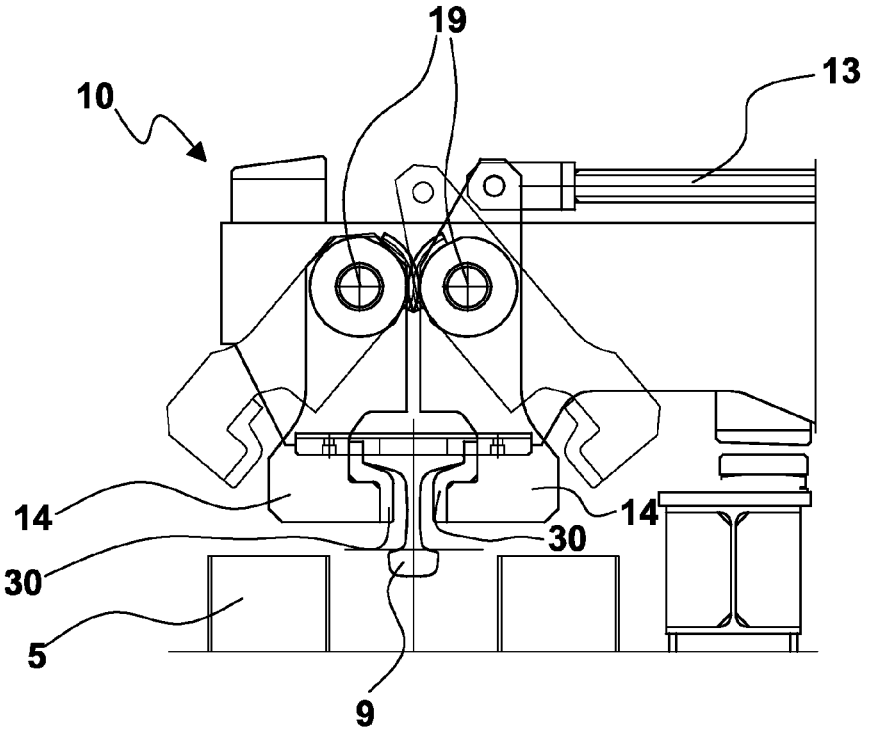
FIG. 2*a* shows a side view of a first part of the handling machine for rails according to the invention, with a handler arranged in an immersion position of the rail head in tank.
Figure 2B:
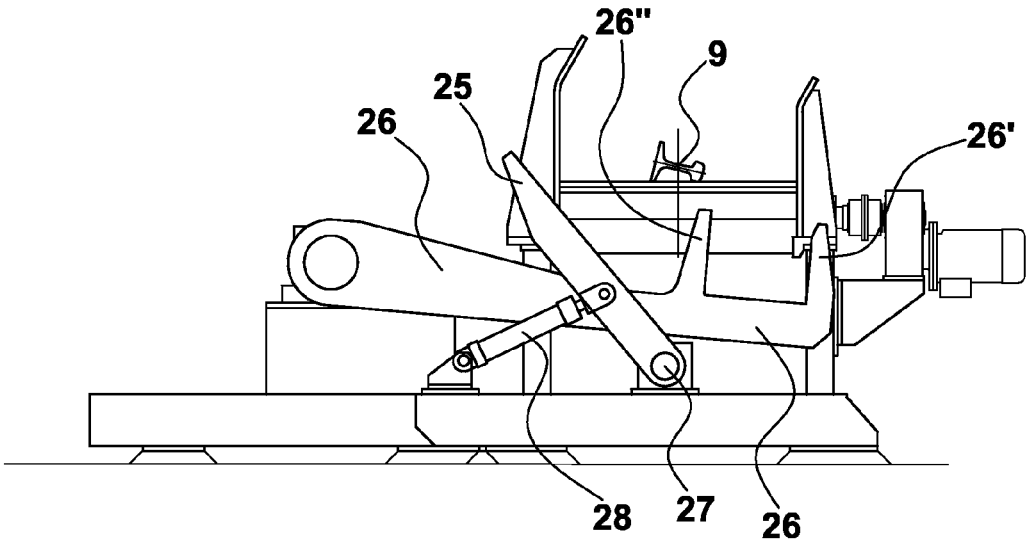
FIG. 2*b* is a side view of a second part of the handling machine for rails according to the invention.

FIGS. 2*a* and 2*b* show a preferred embodiment of a handling machine for rails according to the present invention. The rails are provided with a head, a core and a flange or sole. The flange, in turn, comprises a flat base, the sides and the back, the surfaces of which are inclined with respect to the base plane. The sides and the inclined surfaces are connected by a connecting section.

Figure 3:
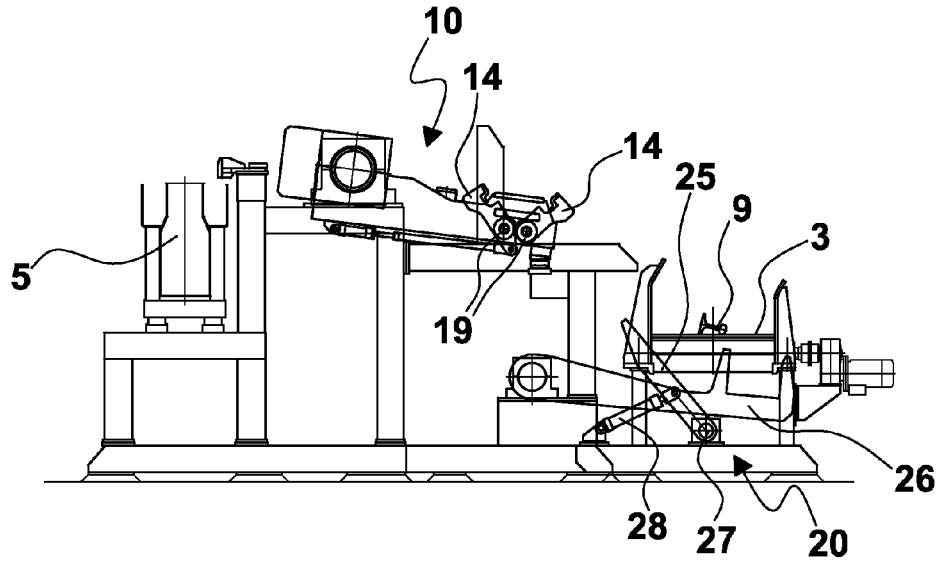
FIGS. 3 to 14 show some steps of the process of handling rails by means the machine according to the invention.
Figure 8:
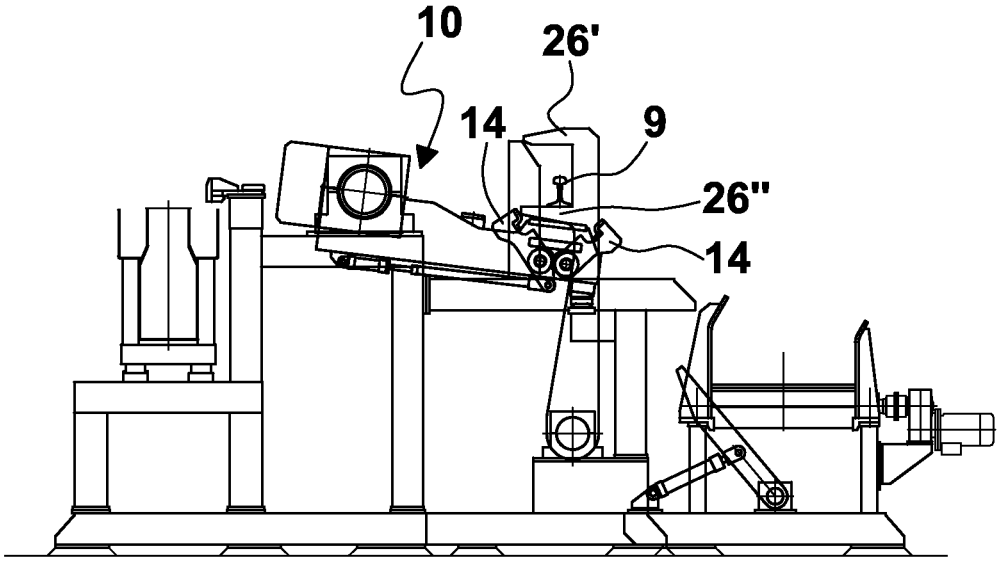
Figure 14:
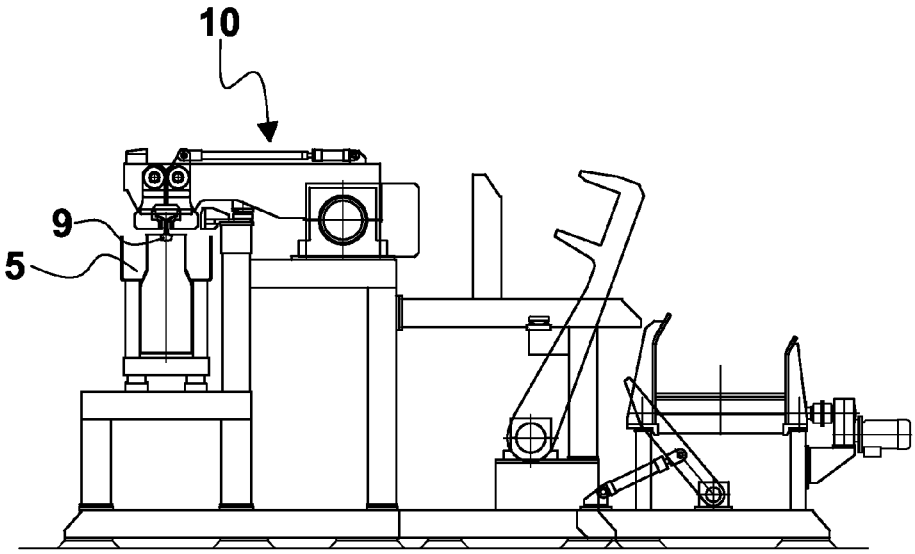

Such a machine comprises, in a first variant:

a longitudinal roller table 3, arranged in line directly along the rolling axis X, which receives the rail 9 exiting from the last rolling mill stand;

a longitudinal cooling tank 5, arranged adjacent and parallel to said roller table 3, for thermally treating the rail 9 by immersion in a cooling fluid contained in said tank;

a plurality of moving means 20, arranged along the roller table 3, for drawing the rail 9 from the roller table 3 and overturning it from a position in which it is resting on a side on the roller table with the flange turned towards the cooling tank 5 (FIG. 3), position with which the rail arrives on the roller table, to a position with the head turned upwards out of the roller table 3 (FIG. 8);

a plurality of handlers 10 provided with clamps, adapted to clamp the rail 9 at the flange and turn it from the position on the roller table with the head turned upwards (FIG. 8) to a position with the head turned downwards and immersed in the cooling tank 5 (FIG. 14).

The aforesaid position of the rail with the head turned upwards is not on the roller table 3 but near the resting position of the handlers 10 (FIGS. 3 to 8). The fact of providing intermediate moving means of the rails which transfer the rails from the roller table 3 to the handlers 10, provided in the thermal treatment area, avoids the direct exposure of the handlers to the higher thermal load present close to the roller table. This further makes maintenance operations in the thermal treatment area easier because the latter is more distanced from the roller table than the solutions of the prior art.

The cooling tank 5 has a longitudinal extension such as to allow the entire rail to be immersed therein. Once the thermal treatment of the head has been completed, the rails are unloaded from the roller table onto a cooling plate or bed 8.

The moving means 20, arranged along the roller table 3 with step e.g. equal to 1.5 meters, each comprise:

- a lever 25, known as a pusher, which, actuated by a hydraulic cylinder 28 or other suitable actuating means, turns about an oscillation pin 27 thereof by a predetermined angle, e.g. 30°, moving the rail 9, lopsided or inclined on a side, to the side part of the roller table 3 distal from the cooling tank (FIGS. 3 and 4);
- a lever 26 integrally fixed at a first end thereof onto a transmission shaft 11', provided in a side position with respect to the roller table 3, and provided on a second end thereof with two projecting parts 26', 26" configured so that said second end defines a substantially U-shaped space, to accommodate a portion of rail during the rotation of said lever 26.

Figure 4:
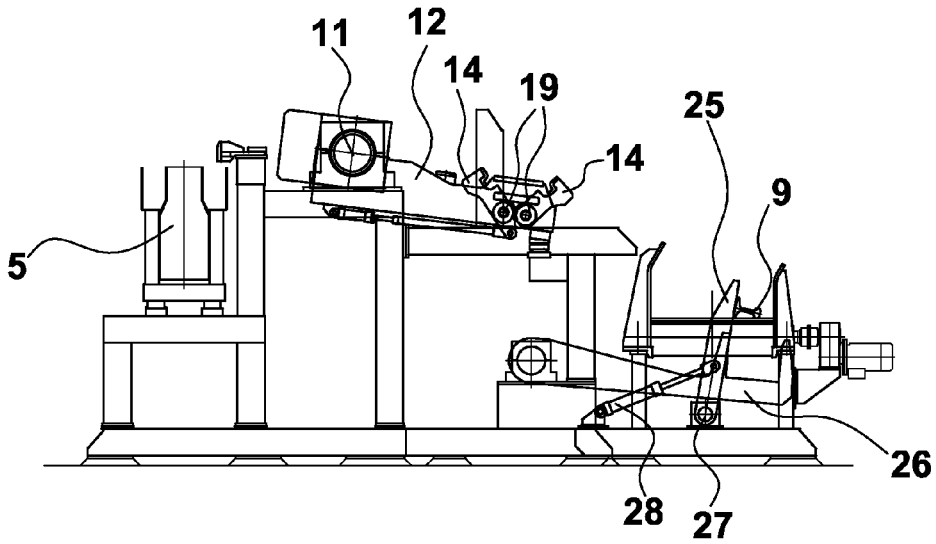
Figure 5:
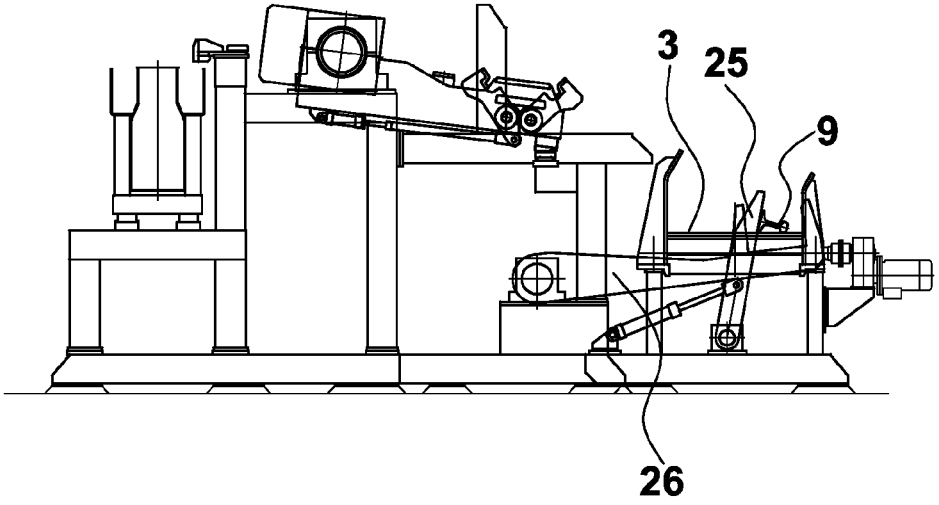
Figure 6:
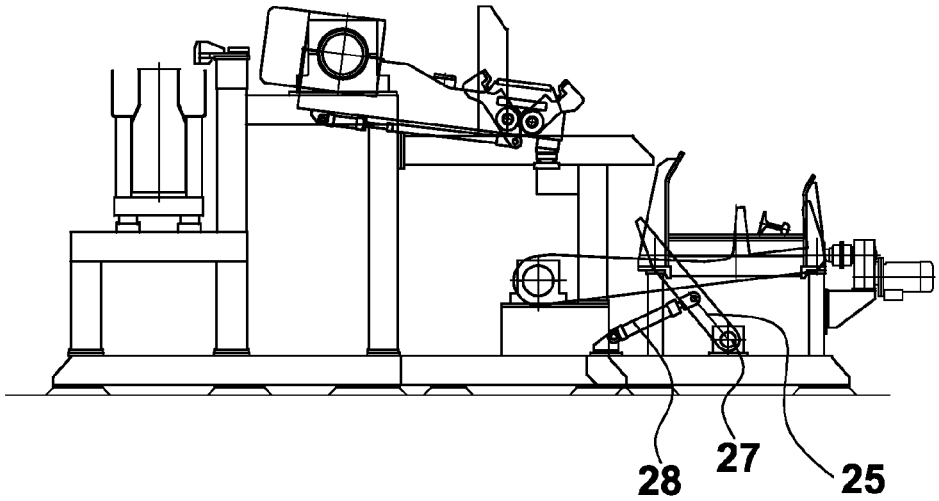
Figure 7:
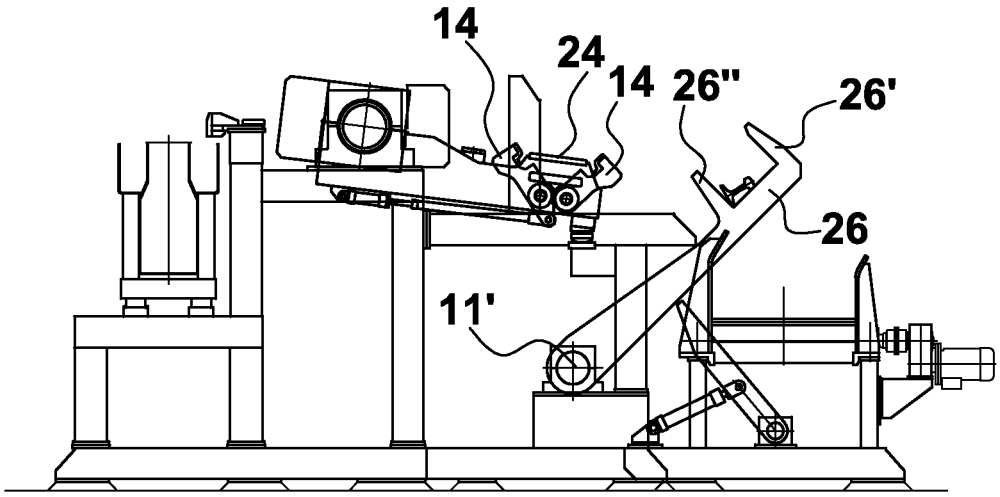

Advantageously, the configuration of the lever 26 is such that, in resting position, the second end thereof is positioned under the side part of the roller table 3 distal from the cooling tank (FIG. 4).

The handlers 10, arranged along the roller table 3 with step e.g. equal to 3 meters, each comprise an arm 12 integrally fixed at an end thereof onto a transmission shaft 11, provided in an intermediate position between the tank 5 and the roller table 3.

Each arm 12 is provided on the other end with a clamp the jaws 14 of which are hinged to fulcrums or rotation pins 19. A hydraulic actuator 13 or other appropriate actuation means is also provided on each arm to actuate the jaws 14. Other moving means of the jaws 14 may be provided in cooperation with said hydraulic actuator 13.

Figure 15:
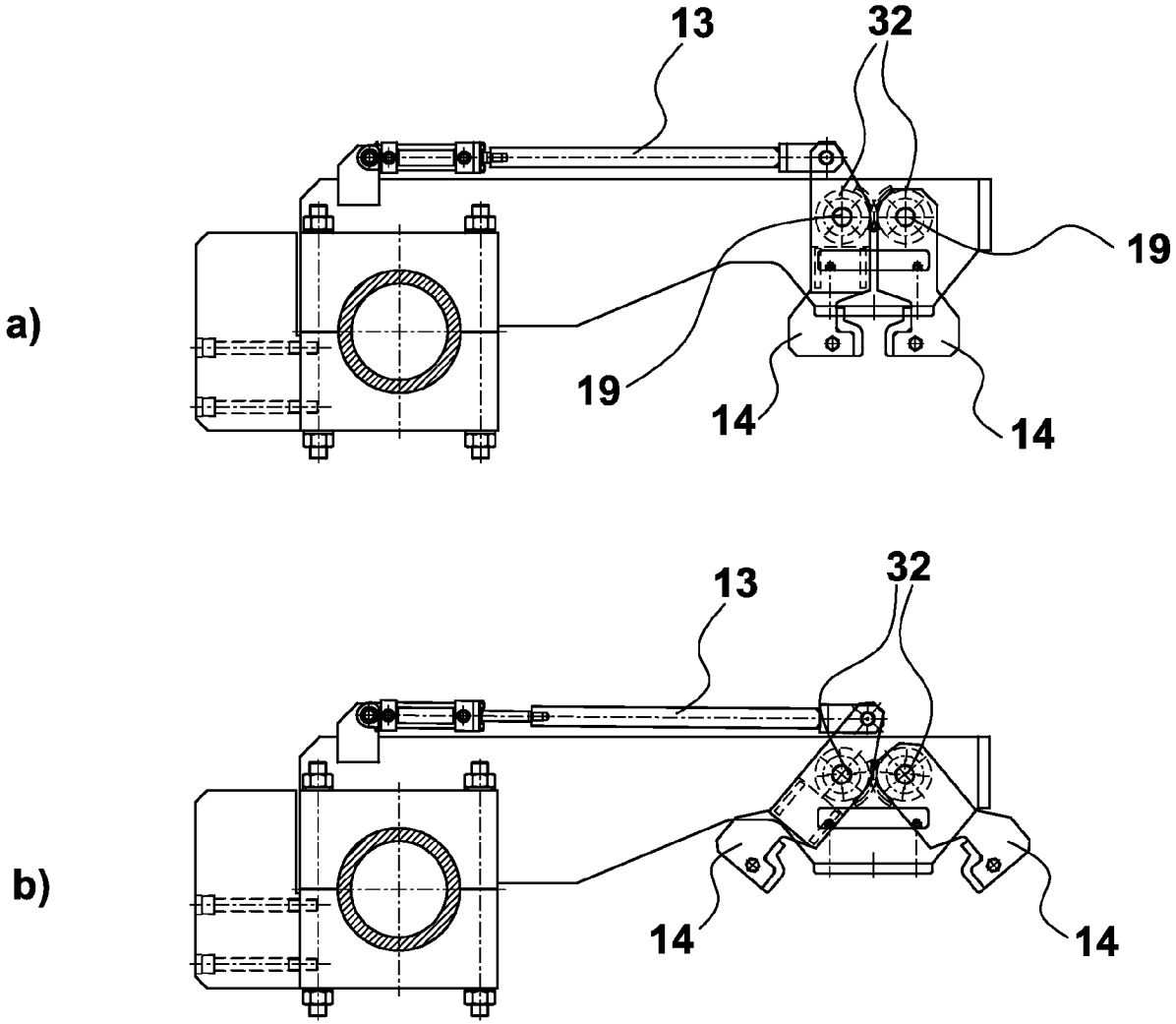
FIG. 15 shows a first embodiment of the actuating means of the clamps in two different positions.

FIG. 15 shows a first variant in which a pair of mutually meshing pinions 32 are provided integrally mounted on respective rotation pins 19 of the jaws 14: the hydraulic actuator 13 is configured to actuate one of the two pinions thus causing the opening of both jaws 14. This solution has the advantage that the actuating system is small in size and moves the jaws always in a symmetric way.

FIGS. 16 to 19 show further four variants in which leverages instead of pinions are included. These lever systems have the advantage that the transmission system between the jaws does not provide mesh engagements exposed to the high thermal load, due to the proximity of the rail and to fouling by metallic flakes coming from the rail itself, with respect to the solution with pinions.

Figure 16:
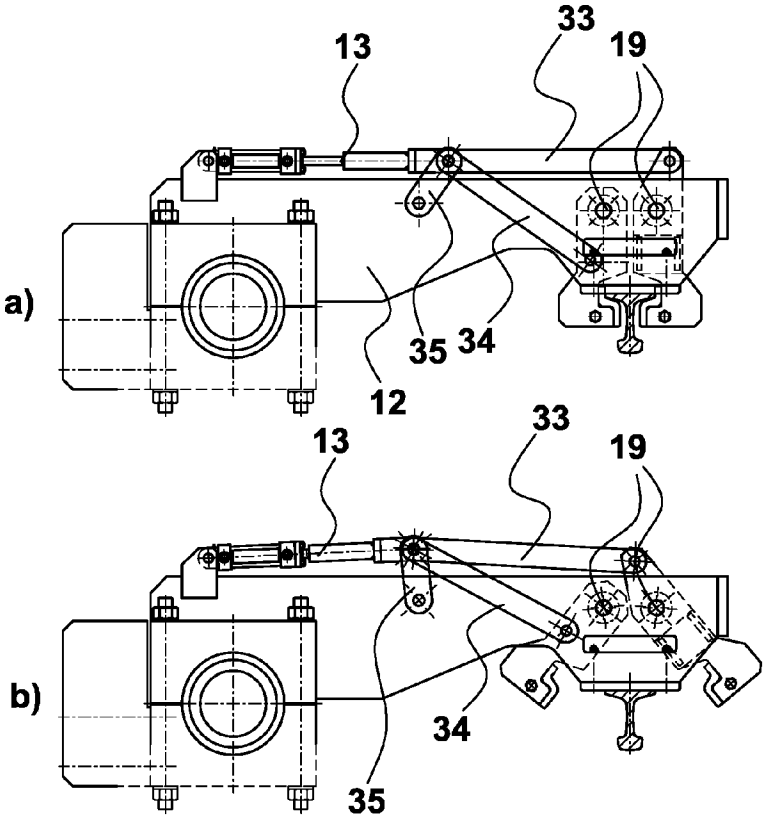
FIG. 16 shows a first variant of a second embodiment of the actuating means of the clamps in two different positions.

In particular, the first variant in FIG. 16 comprises a system of three rods 33, 34 and 35. Rod 35 is hinged, at a first end thereof, to the arm 12 of the handler and, at a second end thereof, to the actuator 13. Both rods 33 and 34 are hinged at a respective first end thereof, along with the rod 35, to the actuator 13; at the respective second end thereof they are instead hinged to respective appropriate points of the jaws 14.

FIG. 16*b* shows the jaws 14 in open position while FIG. 16*a* shows the jaws 14 in closed position.

This first variant has a small encumbrance; it provides for closing the jaws by means of a pushing action of the hydraulic actuator, therefore with a higher closing force; it provides for a non-symmetric movement of the jaws. Furthermore, the jaws 14 are not symmetric in the maximum opening position, while they are so in the closing position.

Figure 17:
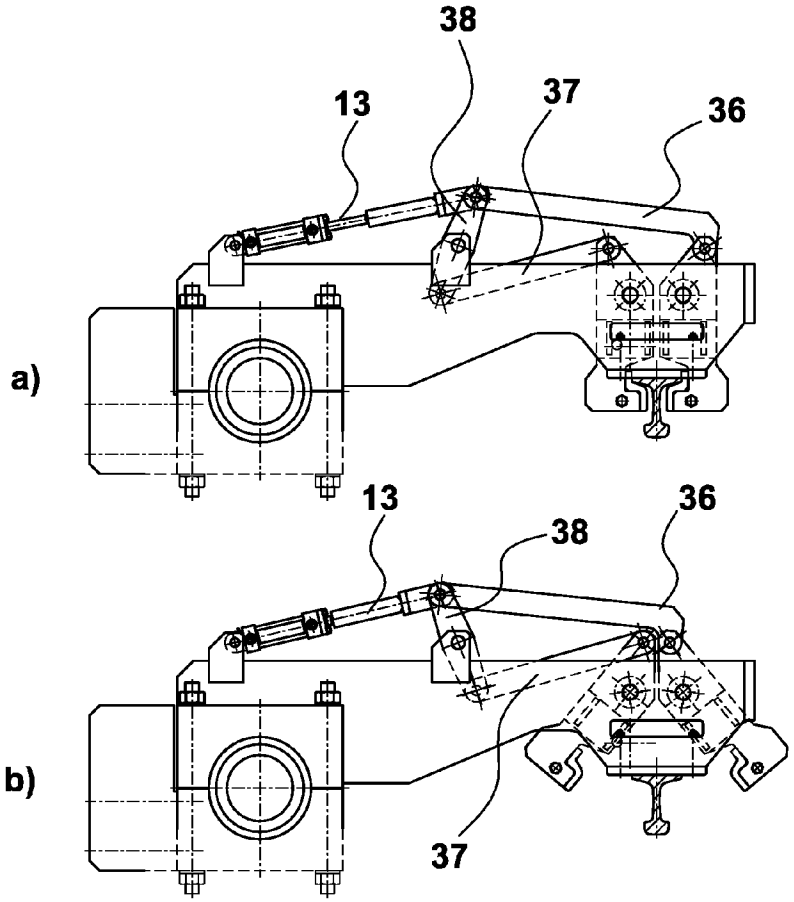
FIG. 17 shows a second variant of the second embodiment of the actuating means of the clamps in two different positions.

The second variant in FIG. 17 comprises a two rod 36, 37 system and a rocker arm 38. The rocker arm 38 is hinged, at a first end thereof, to the actuator 13 and, in the central zone thereof, is hinged to a support integral with the arm 12 of the handling element 10, or directly to the arm 12. The rod 36 is hinged at a respective first end thereof, along with the rocker arm 38, to the actuator 13; the rod 37 is instead hinged, at a respective first end thereof, to the second end of the rocker arm 38. The rods 36 and 37 are hinged, at respective second ends thereof, to respective appropriate points of the jaws 14.

FIG. 17*b* shows the jaws 14 in open position while FIG. 17*a* shows the jaws in closed position.

This second variant is a bit more cumbersome than the first variant; it provides for closing the jaws by means of a pushing action of the hydraulic actuator. Even in this case, jaws 14 are symmetric in the closing position.

Figure 18:
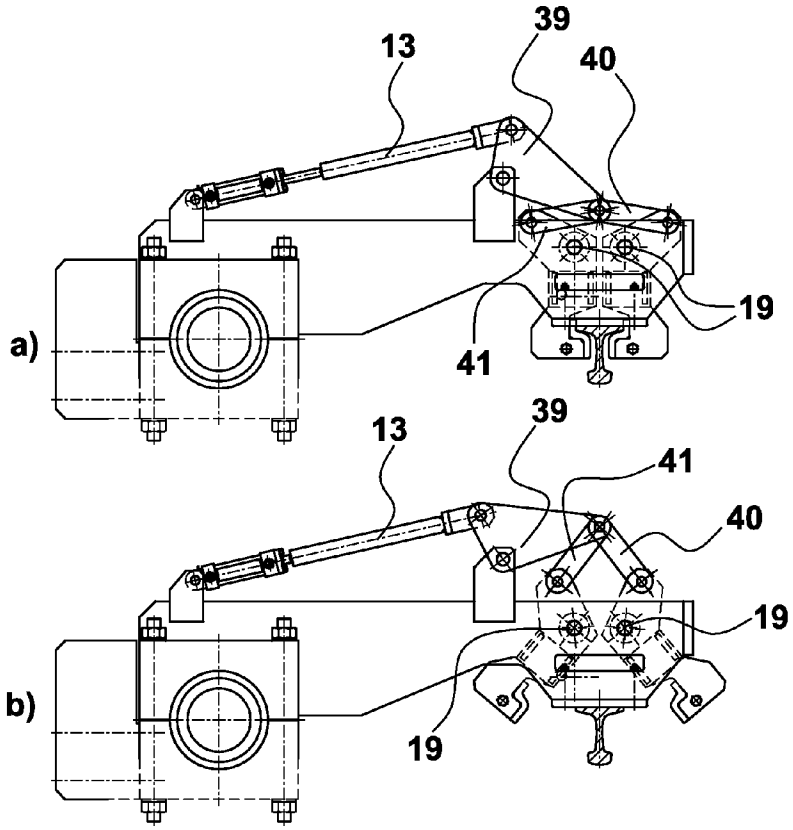
FIG. 18 shows a third variant of the second embodiment of the actuating means of the clamps in two different positions.

The third variant in FIG. 18 comprises a system provided with a lever 39 and two rods 40 and 41. The lever 39, having in this example a triangular shape, is hinged respectively to the actuator 13 at a first vertex, to a support integral with the arm 12 of the handler or directly to the arm 12 at a second vertex, and to the first ends of the rods 40, 41 at a third vertex. The rods 40 and 41 are hinged, at respective second ends thereof, to respective appropriate points of the jaws 14.

FIG. 18*b* shows the jaws 14 in open position while FIG. 18*a* shows the jaws in closed position.

This third variant is more cumbersome than the second variant; it provides for closing the jaws by means of a pushing action of the hydraulic actuator; it provides for a non-symmetric jaw movement. The jaws 14 are symmetric both in the maximum opening and in clamping position. This solution ensures a very strong, firm clamping.

Figure 19:
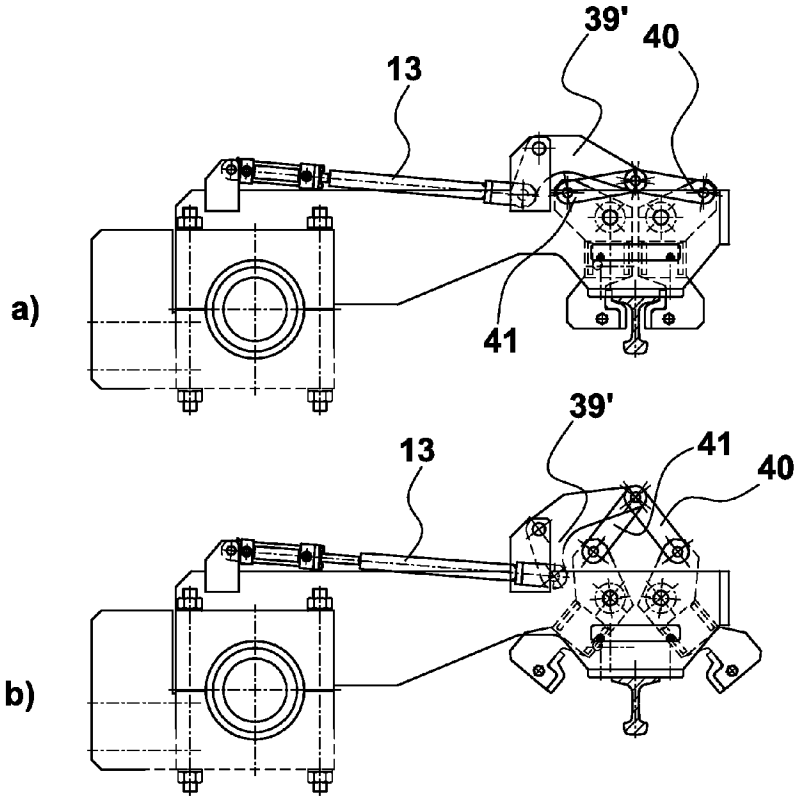
FIG. 19 shows a fourth variant of the second embodiment of the actuating means of the clamps in two different positions.

Finally, the fourth variant in FIG. 19 comprises a system provided with a lever 39' and two rods 40 and 41. The lever 39', being substantially L-shaped in this example, with a concave shape facing the arm 12, is hinged at a first end thereof to the actuator 13; is hinged at the central part thereof to a support integral with the arm 12 of the handler or directly to the arm 12; and is hinged at the second end thereof to the first ends of the rods 40, 41. The rods 40 and 41 are hinged, at respective second ends thereof, to respective appropriate points of the jaws 14.

FIG. 19*b* shows the jaws 14 in open position, while FIG. 19*a* shows the jaws 14 in closed position.

The fourth variant is less cumbersome than the third and second variants; it provides for closing the jaws by means of a pulling action of the actuator, therefore with a smaller closing force, the force exerted by the actuator itself being equal; it provides for a non-symmetric movement of the jaws. Jaws 14 are symmetric in maximum opening position and closing position. This solution ensures a very strong, firm clamping despite the actuator operating by pulling, thus with much less force.

The clamps are configured so that the jaws 14 are provided with an internal surface, usually provided on a wear element 30 commonly named "gib", having a profile substantially mating with that of the rail up to about half core and suitable for abutting on the sides of the sole or flange of the rail, leaving a predetermined clearance on the back or inclined surface of the sole. Indeed, the inclination angle of the back of the sole, with respect to the plane of the base of the flange, is smaller than the inclination angle of the mating internal surface of the jaw 14 in clamping position (FIG. 2*a*).

With the rail 9 gripped in the jaws 14 in clamping position (FIG. 2*a*), the bending of the rail itself along its longitudinal extension generates, at some points, the contact of a portion of the connection section between sides and back with a respective portion of the internal surface of the jaws; forces parallel to the symmetry plane of the rail, having intensity of about one order of size higher than that of the closing force exerted by the jaws themselves, are exerted on these contact surfaces.

Advantageously, the resultant of said parallel forces has a through direction either passing through or not very distant from the axis of the respective rotation pin 19. Therefore, the lever of the resultants of the forces parallel to the symmetry plane of the rail, produced by the bending of the rail when the bent rail is clamped by the jaws, with respect to the rotation pins 19 is null or in call cases very small, e.g. up to a maximum of 30 mm and preferably equal to 5 mm. Consequently, the moment generated by said forces parallel to the symmetry plane of the rail with respect to the rotation pins 19 of the closed jaws is either null or negligible. Thereby:

it is avoided the accidental opening of the jaws consequent to the pushes generated by the clamping of a rail which is bending, being subjected to non-uniform thermal fields between sole and head;

relatively low closing forces of the jaws may be used.

The handling machine is divided into modules, each comprising a transmission shaft 11, arranged side-by-side in sequence up to reach the required longitudinal extension of the handling machine.

A control system is provided for each module, preferably a synchronous motor.

The transmission shafts 11 of the various modules are controlled by respective motors. Advantageously, if drive problems occur in any module of the plant, the shafts 11 are provided on one end with a connection element adapted to mesh with a respective recess provided on the proximal end of the subsequent shaft 11.

Figure 9:
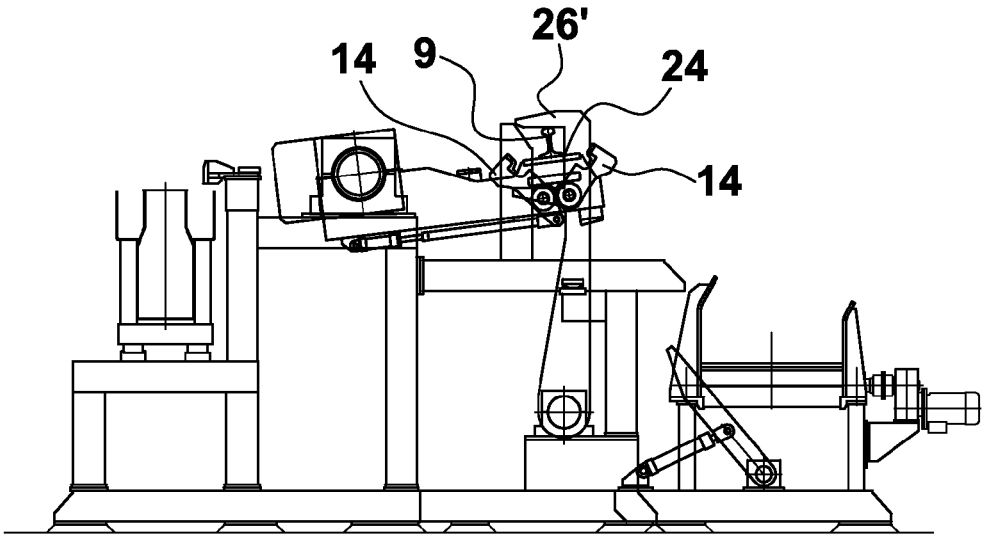
Figure 10:
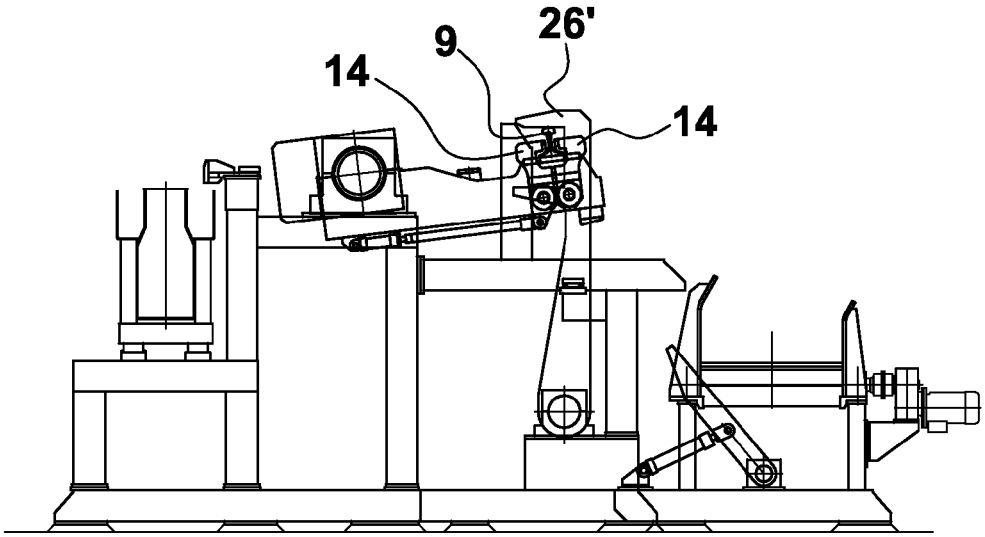
Figure 11:
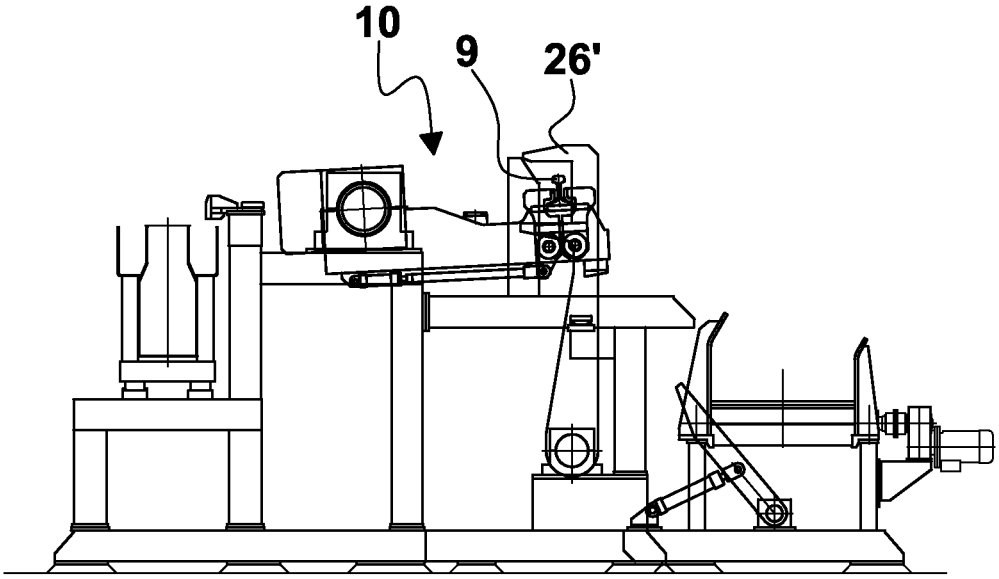
Figure 12:
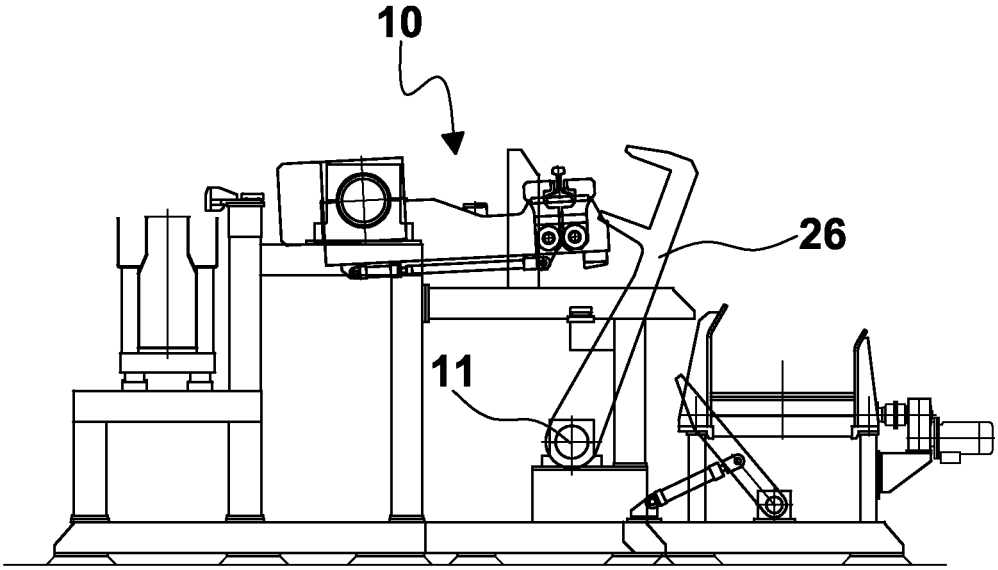
Figure 13:
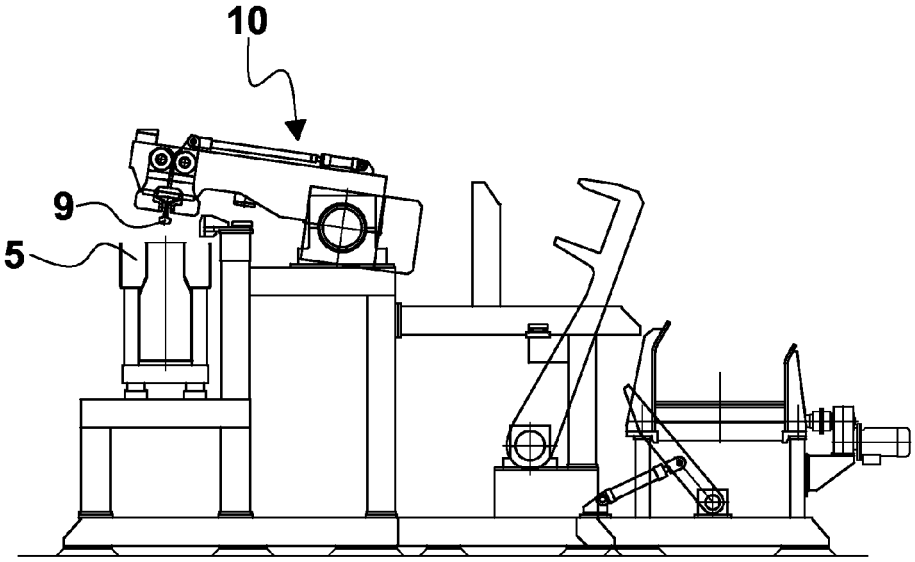

The handling process of the rails, carried out by means of the aforesaid first embodiment of the handling machine, comprises the following steps:

1) unloading a rail 9 in a lopsided position, that is inclined on a side thereof, onto the roller table 3; during this step of receiving the rail, pushers 25 and levers 26 are in the respective external resting positions and underneath the roller table 3 (FIG. 3);
2) actuating the pushers 25 by means of the hydraulic cylinders 28 so as to turn them by a predetermined angle, e.g. about 30°, in a first direction of rotation about respective pins 27, moving the rail 9, inclined on a side thereof, laterally with respect to the longitudinal middle plane of the roller table 3 itself, in particular on the side part of the roller table 3 distal from the tank 5 (FIG. 4);
3) possibly actuating the second levers 26 so as to obtain a partial lifting thereof, with the bottoms of the spaces which accommodate rail 9 still under the plane defined by the roller table 3 (FIG. 5);
4) actuating the pushers 25 by means of the hydraulic cylinders 28 so as to turn them in a second rotation direction, opposite to the first one, about respective pins 27 to return to the respective resting positions (FIG. 6);
5) actuating the levers 26 by means of the transmission shaft 11' so that they turn in a respective first rotation direction by a predetermined angle, substantially about 90°, thus accommodating the rail 9 in the end spaces, lifting it from the roller table 3 and overtuning it in a position with the head turned upwards: during rotation, the rail 9 slides along the bottom of the spaces up the contact with the projecting parts 26" (FIG. 7) and, at the end of the stroke of the levers 26, reaches the position with the head turned upwards and the base of the flange resting on the projecting parts 26" (FIG. 8);
6) possibly centering the rail 9 on the projecting parts 26" by means of the clamps of the handlers 10 to prevent dragging on the rail, in particular on the head ends and tail ends, during the step of clamping by the clamps;
7) straightening the rail 9 by means of the cooperation between handlers 10 and projecting parts 26' of the levers 26; starting from the resting position (FIG. 8) the handlers 10 rotate with open jaws 14 so as to raise the rail 9, by means of a supporting surface 24, until reaching a cooperation position with the levers 26 (FIG. 9) in which the rail head is appropriately detached from the projecting parts 26', e.g. by a few centimeters, except for the points of higher bending of the rail in which there is a contact between rail head and projecting parts 26' of the levers 26 remained in raised position;
8) clamping the rail 9, in the aforesaid position in FIG. 9, by means of the complete closing of the jaws 14 which abut on the sides of the flange leaving instead a predetermined clearance between jaws and upper surface of the flange (FIG. 10);
9) slightly downward rotating the handlers 10 to detach the rail head from the projecting parts 26', so as to prevent dragging on the surface of the rail head in the following step 10);
10) actuating the levers 26 by means of the transmission shaft 11' so that they turn in the respective second rotation direction (FIG. 12) at least to exit from the area of operation of the handlers 10;
11) rotating the handlers 10 in a first rotation direction, by about 170°, to position the head of the rail 9 turned downwards at a predetermined distance from the cooling tank 5 (FIG. 13); the rail 9 is maintained in this position until the head reaches a predetermined surface temperature of at least 720° C. by means of cooling in air;
12) further rotating the handlers 10 in the first rotation direction to an immersion position of the rail head into the tank 5 (FIG. 14); this cooling by means of the cooling liquid contained in the tank lasts until a surface temperature of the rail head from 50 to 150° C. higher than the temperature Ar3 is reached so as to prevent the phase transformation from austenite into pearlite;
13) rotating the handlers 10 in the second rotation direction, opposite to the first, until the head of the rail 9 is positioned turned downwards at said predetermined distance from the cooling tank 5 (same position of FIG. 13); the rail 9 is maintained in this position until the surface temperature of the head is equalized to the temperature of a surface layer of the head of the rail by means of cooling in air; said surface layer having a depth comprised between 15 and 25 mm from the surface of the head;
14) rotating the handlers 10 in the first rotation direction to the immersion position of the rail head into the tank 5 (same position of FIG. 14); this further cooling by means of cooling liquid lasts until a surface temperature of the rail head lower than 500° C. is reached, whereby the phase transformation from austenite into pearlite occurs;
15) rotating the handlers 10 in the second rotation direction by about 170°-180°, to position the head of the rail 9 turned upwards substantially at the position in which clamping has been carried out;
16) actuating the levers 26 so as that they turn in the respective first rotation direction so that the projecting parts 26' reach the aforesaid cooperation position with the rail head (same position of FIG. 10);

17) opening the jaws 14 and further rotating of the handlers 10 in the second rotation direction until the sole of the rail rests on the projecting parts 26" (same position of FIG. 8);

18) actuating the levers 26 by means of the transmission shaft 11' so that they turn in the respective second rotation direction by a predetermined angle, substantially by about 90°, returning the rail 9 onto the roller table 3 in the position inclined on a side thereof, with the flange facing the cooling tank 5, and arranged laterally with respect to the longitudinal middle plane of the roller table 3 itself.

At this point, the thermally treated rail is ready to be fed on the roller table 3 and then be unloaded on a cooling plate.

After completing the thermal rail quenching treatment, comprising four steps of cooling—respectively in air, in liquid, in air and in liquid—a surface layer from 15 to 25 mm deep is advantageously obtained on the rail head starting from the external surface of the head, said layer having a uniform, fine grain pearlite structure with a grain size preferably comprised between values 9 and 4 according to Russian standard GOST 8233-56.

At the outlet of the last rolling stand 2, the rail 9 is unloaded onto the roller table 3 in a position inclined on a side thereof with the flange facing the cooling tank 5 (case shown in the figures); alternatively, it may be unloaded onto the roller table 3 in a position inclined on a side with the head facing the cooling tank 5 (case not shown).

The possible centering of the rail 9 on the projecting parts 26" (step 6) occurs by:

slightly rotating the handlers 10 from the resting position with open jaws until the ends of the jaws substantially reach the height of the sole;

partially closing the jaws 14 of the clamps to contact both sides of the flange and centre the rail 9 without clamping it;

reopening the jaws 14.

Measuring the surface temperature of the rail head by means of pyrometers may be provided during step 11) and step 13).

Figure 1:
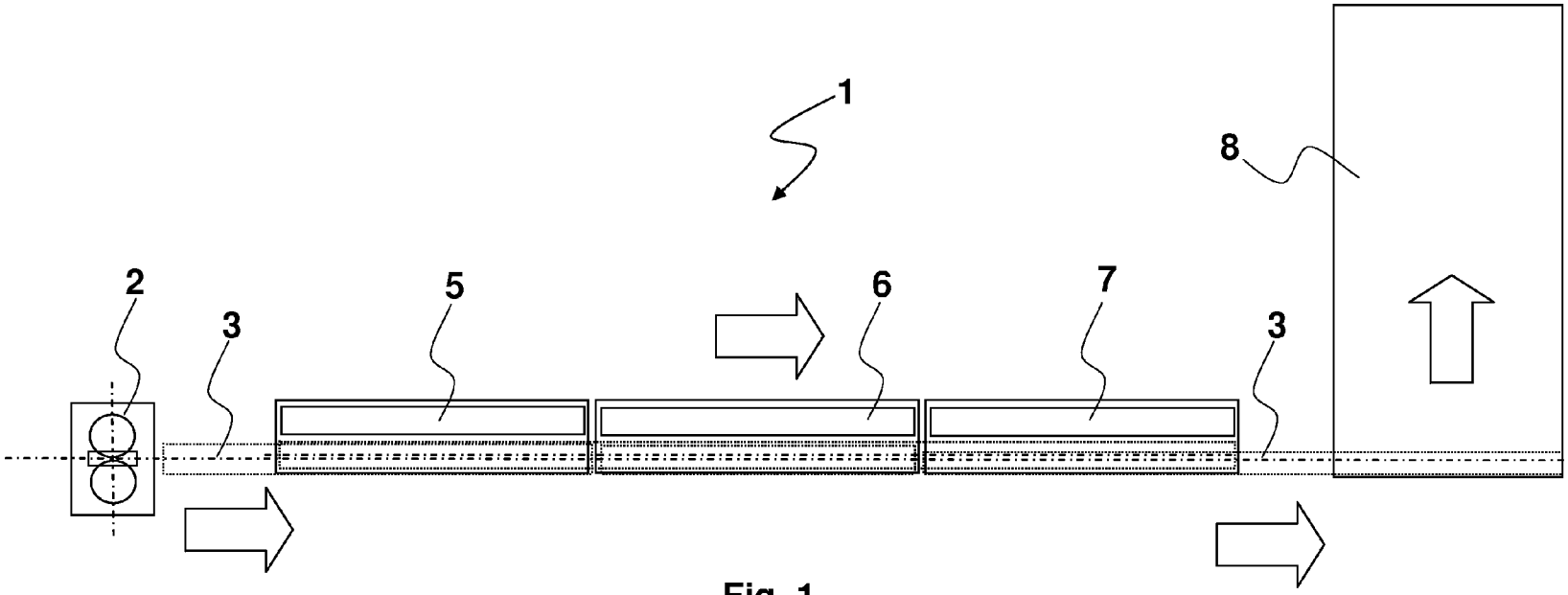
FIG. 1 shows a layout of a thermal treatment plant of the rail head according to the invention.

FIG. 1 shows a layout of a part of the rail production plant comprising a second preferred embodiment of the handling machine according to the present invention.

This example of layout comprises:

a bloom rolling plant suitable for producing rails, or heavy sections, defining an rolling axis X (only the last rolling stand 2 is shown in FIG. 1);

the thermal treatment plant 1 for subjecting the rails to the thermal treatment of head comprising said handling machine;

a cooling plate or bed 8, onto which the treated rails 9 are unloaded.

A possible straightening machine may be provided downstream of the cooling plate 8 used for obtaining the rectilinearity tolerances required and an evacuation roller table towards the finishing area.

The thermal treatment plant 1 comprises:

the longitudinal roller table 3, arranged along the rolling axis X, immediately downstream of the last rolling stand 2, for receiving and forward moving the rails before and after the thermal hardening treatment of the head;

a first longitudinal cooling tank 5, arranged adjacent and parallel to a first initial portion of the roller table 3, for thermally treating the head of a first rail;

a second longitudinal cooling tank 6, arranged adjacent and parallel to a second portion of the roller table 3, said second portion being subsequent to the first portion, for thermally treating the head of a second rail;

a third longitudinal cooling tank 7, arranged adjacent and parallel to a third portion of the roller table 3, said third portion being subsequent to the second portion, for thermally treating the head of a third rail;

optionally, retractable stoppers are arranged along the roller table 3, automatically actuated from the bottom upwards to stop the front end of the rail in the exact position with respect to the tank in which it must be treated.

The cooling tanks 5, 6, 7 have a longitudinal extension such as to allow to immerse the entire rail therein.

Advantageously, said tanks 5, 6, 7 are completely independent because each tank is provided with all plants and systems needed for operation, such as the hydrodynamic unit, the quenching fluid treatment unit, the grease unit, etc. Thereby, any one of the three tanks may be excluded from the treatment cycle for carrying out maintenance while the remaining two tanks continue to work.

Possible croppers may be provided between the thermal treatment plant 1 and the cooling plate 8.

The roller table 3 may be used to unload directly onto the plate 8 either the rails which do not need to be treated or the heavy sections which need no treatment.

In the preferred variant shown in the figures, the roller table 3 is arranged at a standard height from the ground, about 800 mm, while the cooling tanks 5, 6, 7 with respective handlers 10 are arranged in a higher position at which the rail 9 arrives by means of the levers or transfer arms 26. This arrangement allows to make less deep foundations for the thermal treatment area with considerable reduction of costs.

The following are provided also along the second and third portions of the roller table 3:

a plurality of moving means 20 for drawing the rail 9 from the roller table and turning it over from a position inclined on a side thereof with the flange facing the respective cooling tank 6, 7, position in which the rail reaches the second and third portion on the roller table 3, to a position with the head turned upwards close to the resting position (FIG. 8) of the handlers 10;

a plurality of handlers 10, arranged between the roller table 3 and second cooling tank 6 for clamping a rail and turning it so as to immerse it in said tank 6 and between the roller table 3 and the third cooling tank 7 to clamp and a rail and turn it so as to immerse it in said tank 7. Further transmission shafts 11 are thus respectively provided in an intermediate position between tank 6 and roller table 3 and between tank 7 and roller table 3 itself.

Openings are provided along the roller table 3 for the passage of the levers or pushers 25 or the levers 26.

Figure 20:
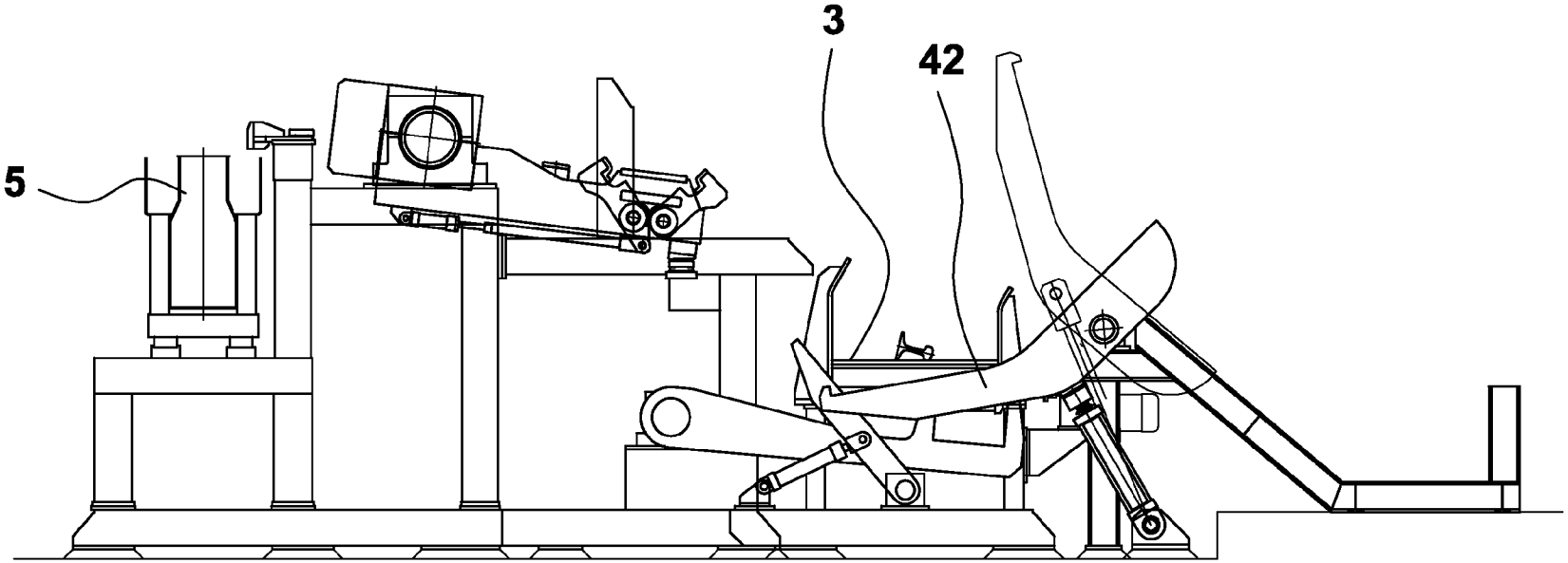
FIG. 20 shows a cross view of the plant in which a movable bag for removing the rolled material from the roller table in case of a downstream emergency is shown.

In an advantageous variant, movable bags 42, arranged laterally with respect to the roller table 3, are provided at respective portions of the roller table 3 to remove rolled material, rail or profile from the roller table itself in case of downstream emergency. A movable bag 42 is shown in FIG. 20 at a first portion of the roller table 3 and of the cooling tank 5.

After unloading a rail 9 on the roller table 3, if the first cooling tank 5 is free, the handling process according to the invention comprises the following steps:

the rail 9 is moved and turned over from a position inclined on a side thereof on the first position of the roller table 3 in a position with the head turned upwards close to the resting position of the jaws 14 of the handlers 10, as described above for the steps 2) and 5);

steps from 6) to 18) are carried out in the zone of the plant comprising the cooling tank 5 and the respective first portion of the roller table 3;

feeding the rail 9 along the second portion and the third portion of the roller table 3, next to which the second 6 and the third 7 cooling tanks are placed, without interfering with the handlers and the moving means provided along said second and third portions of the roller table 3;

unloading the rail 9 with the head thermally treated on the cooling plate 8.

If the first cooling tank 5 is occupied by a previous rail instead, the rail 9 is transferred into the second portion of the roller table 3 and:

if the second cooling tank 6 is free, the rail is turned over, clamped and the head is thermally treated in said second tank 6 as described in from steps 2) to 18);

if the second cooling tank 6 is occupied, the rail is transferred to the third portion of the roller table 3 where it is turned over and clamped and the head is thermally treated in the third cooling tank 7 as described in from steps 2) to 18).

The main advantage obtained by this second embodiment of the handling machine is represented by a production rate of 27-28 rails/hour and an hourly production rate of 180-200 tons/hour.

The invention claimed is:

1. Handling machine for a rail provided with a head and a flange, the machine comprising:

a plurality of moving means for taking and turning over the rail from a position inclined on a side thereof to a position wherein the head of the rail is turned upwards;

a plurality of handlers provided with clamping means adapted to clamp the rail at the flange, and able to move the rail from said position wherein the head of the rail is turned upwards to a position wherein the head is turned downwards, wherein said moving means are configured to transfer the rail to the plurality of handlers, and comprise first levers adapted to be actuated by first actuating means and configured so that they move the rail from the position inclined on a side thereof, provided on a first resting plane, to the position with the head of the rail turned upwards and with a base of the flange resting on a second resting plane higher than said first resting plane.

2. Machine according to claim 1, wherein the first levers are integrally fixed, at a respective first end, to a transmission shaft, and are provided at the respective second end with two projecting parts configured so that said second end defines a space to house a portion of rail during the movement of the first levers.

3. Machine according to claim 1, wherein the moving means comprise second levers adapted to be actuated by second actuating means and configured in order to translate the rail along said first plane from a first position inclined on a side thereof to a second position inclined on the same side.

4. Machine according to claim 3, wherein the second levers are rotatable around a respective oscillation pin by a predetermined angle.

5. Machine according to claim 1, wherein said clamping means are provided with two jaws, rotatable around respective rotating pins and configured so that the rail is clamped by means of a contact between portions of internal surface of the jaws and the sides of the flange of the rail only.

6. Machine according to claim 5, wherein the handlers comprise each an arm, integrally fixed at a first end to a transmission shaft, and wherein the jaws of said clamping means are provided at a second end of the arm.

7. Machine according to claim 6, wherein actuating means for actuating the jaws are provided on each arm.

8. Machine according to claim 7, wherein further moving means of the jaws comprising a system with pinions or levers are provided in cooperation with said actuating means.

* * * * *